US005146898A

United States Patent [19]

Itakura et al.

[11] Patent Number: 5,146,898

[45] Date of Patent: * Sep. 15, 1992

[54] FUEL INJECTION CONTROL APPARATUS FOR AN INTERNAL COMBUSTION ENGINE

[75] Inventors: Tomiya Itakura; Hiroshi Kamifuji, both of Katsuta, Japan

[73] Assignees: Hitachi, Ltd., Tokyo; Hitachi Automotive Engineering Co., Ltd., Ibaraki, both of Japan

[ * ] Notice: The portion of the term of this patent subsequent to Oct. 30, 2007 has been disclaimed.

[21] Appl. No.: 601,433

[22] Filed: Oct. 23, 1990

Related U.S. Application Data

[63] Continuation of Ser. No. 416,408, Oct. 3, 1989, Pat. No. 4,966,118.

[30] Foreign Application Priority Data

Oct. 14, 1988 [JP] Japan ..... 63-257157

[51] Int. Cl.[5] ..... F02D 41/10; F02D 41/12

[52] U.S. Cl. ..... 123/492; 123/493

[58] Field of Search ..... 123/436, 492, 493, 352, 123/395, 399; 364/431.07, 424.01, 426.04, 426.01; 180/170, 178, 179

[56] References Cited

U.S. PATENT DOCUMENTS 4,809,175 2/1989 Hosaka et al. ..... 364/426.04
4,842,342 6/1989 Takahashi et al. ..... 364/424.01
4,852,007 7/1989 Yasunobu et al. ..... 364/426.01
4,862,854 9/1989 Oda et al. ..... 123/399
4,922,428 5/1990 Takahashi ..... 364/426.04
4,926,826 5/1990 Nakaniwa et al. ..... 123/440 X
4,930,084 5/1990 Hosaka et al. ..... 364/426.04
4,958,288 9/1990 Takahoshi ..... 364/426.04
4,966,118 10/1990 Itakura et al. ..... 123/492
5,001,640 3/1991 Matsumoto et al. ..... 364/426.01
5,021,958 6/1991 Tokoro ..... 180/170

*Primary Examiner*—Tony M. Argenbright
*Attorney, Agent, or Firm*—Antonelli, Terry, Stout & Kraus

[57] ABSTRACT

A fuel injection control apparatus for an internal combustion engine has a controller, which includes a microprocessor for executing a predetermined processing in response to fundamental parameters representing the operational condition of the engine, produces a basic fuel injection pulse on the basis of a suction air quantity and a rotational speed of the engine and corrects the basic fuel injection pulse in accordance with the degree of acceleration or deceleration required, thereby to provide a fuel injection pulse applied to a fuel injector. The microprocessor is provided with membership functions varying with respect to acceleration or deceleration and determines a correction coefficient for correcting the basic fuel injection pulse on the basis of the degree of acceleration or deceleration required in accordance with a fuzzy reasoning using the membership functions.

7 Claims, 8 Drawing Sheets

FUEL INJECTION CONTROL APPARATUS FOR AN INTERNAL COMBUSTION ENGINE

This application is a continuation application of application Ser. No. 07/416,408 filed Oct. 3, 1989 now U.S. Pat. No. 4,966,118.

BACKGROUND OF THE INVENTION

1. Field of the Invention

The present invention relates to a fuel injection control apparatus for an internal combustion engine, and more particularly to a control apparatus for a fuel injection system capable of exhibiting excellent performance, especially when the engine is accelerated or decelerated.

2. Description of the Related Art

When an automobile is accelerated or decelerated, the degree of acceleration or deceleration is determined depending on the amount of actuation of the accelerator pedal by the driver. If a driver wants to drive the automobile faster, he will further depress the accelerator pedal, and if he wants to slow down, he will release the pedal to some extent.

However, the amount of actuation of an accelerator pedal is caused by the indefinite or fuzzy will of a driver. He usually has his will not so definitely set as to want to drive 5 km/h or 20 km/h faster than the present speed, but so indefinitely that he wants to drive "somewhat" or "much" faster.

On the other hand, when an automobile is accelerated, the engine thereof is supplied an air-fuel mixture, which is enriched by a predetermined quantity of fuel. This is known as a so-called acceleration enrichment. Further, in an engine which is subject to such an acceleration enrichment, it is also known that fuel is cut off, when the automobile is decelerated. The fuel supply control as mentioned above is described, for example, in the first column of U.S. Pat. No. 4,589,389 issued to Kosuge et al in 1986 and assigned to the same assignee.

By the way, in conventional fuel supply control, the aforesaid acceleration enrichment has been always automatically carried out by increasing a certain amount of fuel, when an opening of a throttle valve exceeds a predetermined value. The amount of fuel to be increased is determined definitely depending on the load of the engine (cf., for example, Japanese Patent laid-open publication JP-A-58/15725 (1983)). Similarly, the cut-off of fuel has been done automatically when deceleration is required.

Therefore, a conventional control apparatus has not always been suited for reflecting the driver's fuzzy or indefinite will as mentioned above on the fuel supply control. The present invention is intended to cope with the fuzziness in the driver's will by applying a so-called fuzzy reasoning or fuzzy technique to a fuel injection control system for an internal combustion engine.

Incidentally, the application of the fuzzy technique to a control device for automobiles has been known, for example, by the article "Application of A Self-Tuning Fuzzy Logic System to Automatic Speed Control Device" by Takahashi et al, Proc. of 26th SICE Annual Conference II (1987), pages 1241 to 1244.

Briefly, this article discloses an automatic speed control device, in which the fuzzy technique is employed for the purpose of evaluating the difference between a target speed set and an actual speed detected and, on the basis of thus evaluated speed difference, the opening of the throttle valve is controlled such that the actual speed follows the target speed set. In this article, however, there is no disclosure of the application of the fuzzy technique to a fuel injection control system.

SUMMARY OF THE INVENTION

An object of the present invention is to provide a fuel injection control apparatus for an internal combustion engine, which is capable of adequately reflecting the driver's fuzzy or indefinite will as mentioned above on the determination of an amount of fuel to be supplied to the engine.

A feature of the present invention resides in a fuel injection control apparatus comprising a controller, including a microprocessor for executing a predetermined processing in response to fundamental parameters representing the operational condition of an engine, which produces a basic fuel injection pulse based on the fundamental parameters and corrects the basic fuel injection pulse in accordance with the degree of the acceleration or deceleration required thereby to provide a fuel injection pulse applied to a fuel injector, wherein the microprocessor is provided with membership functions varying with respect to acceleration or deceleration and determines a correction coefficient for correcting the basic fuel injection pulse on the basis of the degree of acceleration or deceleration required in accordance with a fuzzy reasoning using membership functions.

According to the present invention, when acceleration or deceleration is required, the amount of fuel to be finally supplied to the engine can be determined not only on the basis of the extent of actuation of the accelerator pedal by a driver, but also by taking into account the driver's indefinite or fuzzy will. As a result, the fuel supply control is effected suitably in response to the driver's indefinite or fuzzy will, whereby the purification of exhaust gas can be improved, while providing the driver with a feeling of good drivability.

DESCRIPTION OF PREFERRED EMBODIMENTS

In the following, description will be made of the present invention in detail, referring to accompanying drawings.

Figure 1:
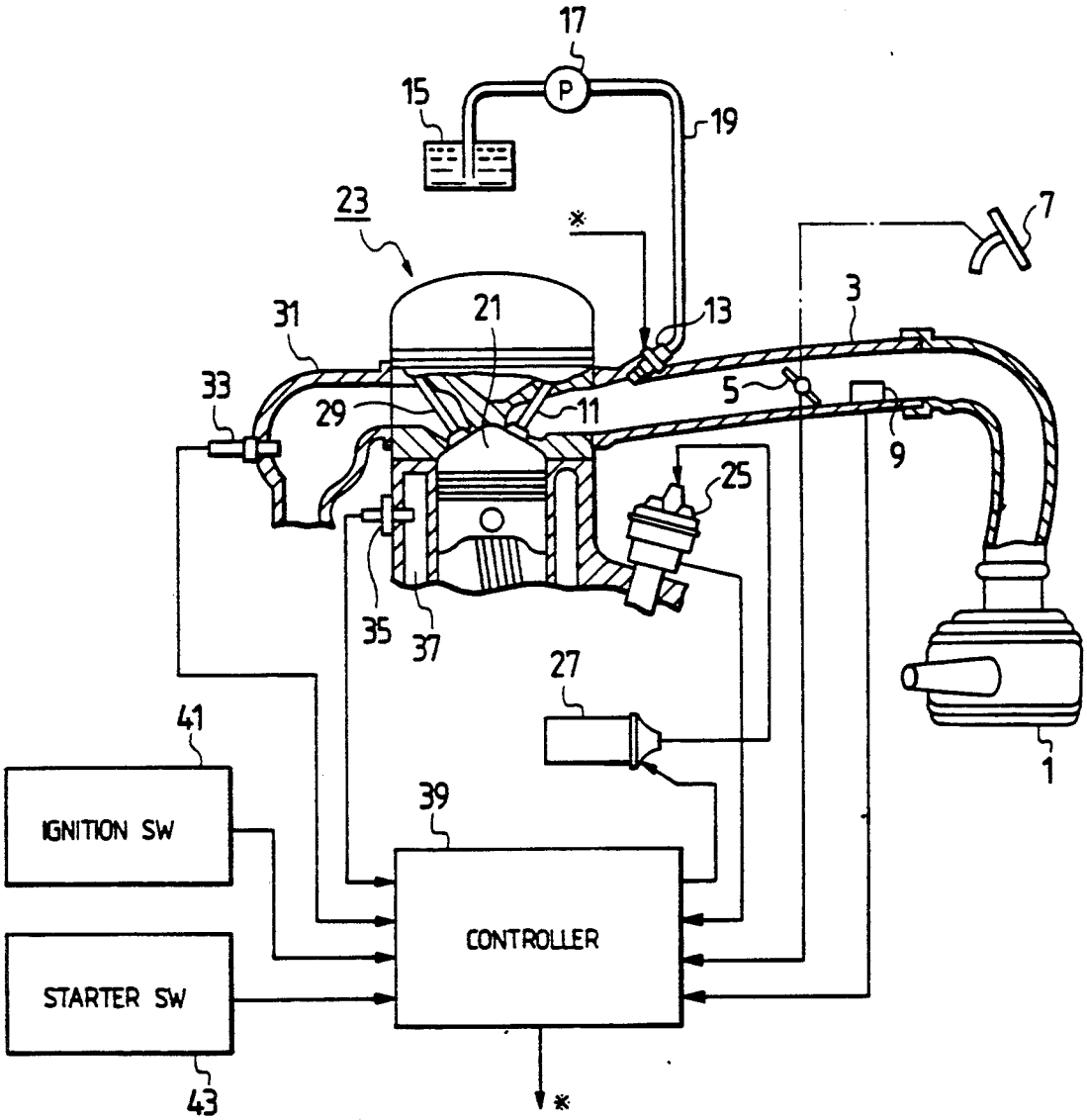
FIG. 1 is a drawing schematically showing an overall construction of an engine control system including a fuel injection control apparatus according to an embodiment of the present invention.

In FIG. 1 there is schematically shown an overall construction of an internal combustion engine, to which a fuel injection control apparatus according to an embodiment of the present invention is applied.

In the figure, air is introduced through an air cleaner 1 to a suction pipe 3. In the suction pipe 3, there is provided a throttle valve 5, which is manipulated by a driver through an accelerator pedal 7. Although not shown in the figure, an opening sensor associated with the throttle valve 5 produces a valve opening signal. There is further provided an airflow sensor 9 in the suction pipe 3, which detects the quantity $Q_a$ of air sucked into the engine to produce an airflow signal.

Injector 13 is installed in the suction pipe 3 near inlet valve 11. The injector 13 is coupled to a fuel tank 15 through a fuel pump 17 and a fuel pipe 19 and is supplied with pressure-regulated fuel. An injection pulse signal, which will be described in detail later, is applied to the injector 13. The injector 13 opens its valve for period of a pulse width of the injection pulse signal applied thereto and injects an amount of fuel in response thereto, whereby a fuel mixture of a predetermined air/fuel (A/F) ratio is supplied.

When the inlet valve 11 is opened, the mixture is sucked into combustion chamber 21 of the engine 23. The mixture is compressed and ignited to be burned. The ignition is performed by an ignition spark plug (not shown), to which a high voltage is applied by ignition unit 27 through distributor 25, a shaft of which rotates with the rotation of a crank shaft (not shown) of the engine 23.

There are provided two sensors within the distributor 25, that is, one of the sensors, called a rotation sensor, detects a rotational angle of the crank shaft of the engine 23 to produce a rotation signal for every predetermined rotational angle thereof, and the other sensor, called a position sensor, detects a predetermined position of the crank shaft to produce a position signal.

After the fuel mixture is burned in the combustion chamber 21, exhaust gas is discharged to exhaust pipe 31, when outlet valve 29 is opened. The exhaust pipe 31 is equipped with an oxygen sensor 33, which detects the air/fuel ratio of the supplied mixture from the concentration of residual oxygen remaining in the exhaust gas and produces an A/F ratio signal. Accordingly, the sensor 33 functions as an A/F ratio sensor and will be so called in the following description.

To a side wall of a cylinder block of the engine 23 there is equipped a water temperature sensor 35, which detects a temperature of cooling water within the water jacket 37 to produce a water temperature signal as a signal indicative of an operating temperature of the engine 23.

The control apparatus of the embodiment has controller 39 including a microprocessor, to which signals produced by the various sensors as mentioned above are applied. Signals from ignition switch 41 and starter switch 43 are also given to the controller 39.

The controller 39 executes a predetermined processing in accordance with various programs stored therein on the basis of the signals applied, whereby the injection pulse signal and the ignition timing signal are produced to the injector 13 and the ignition unit 27, respectively.

Figure 2:
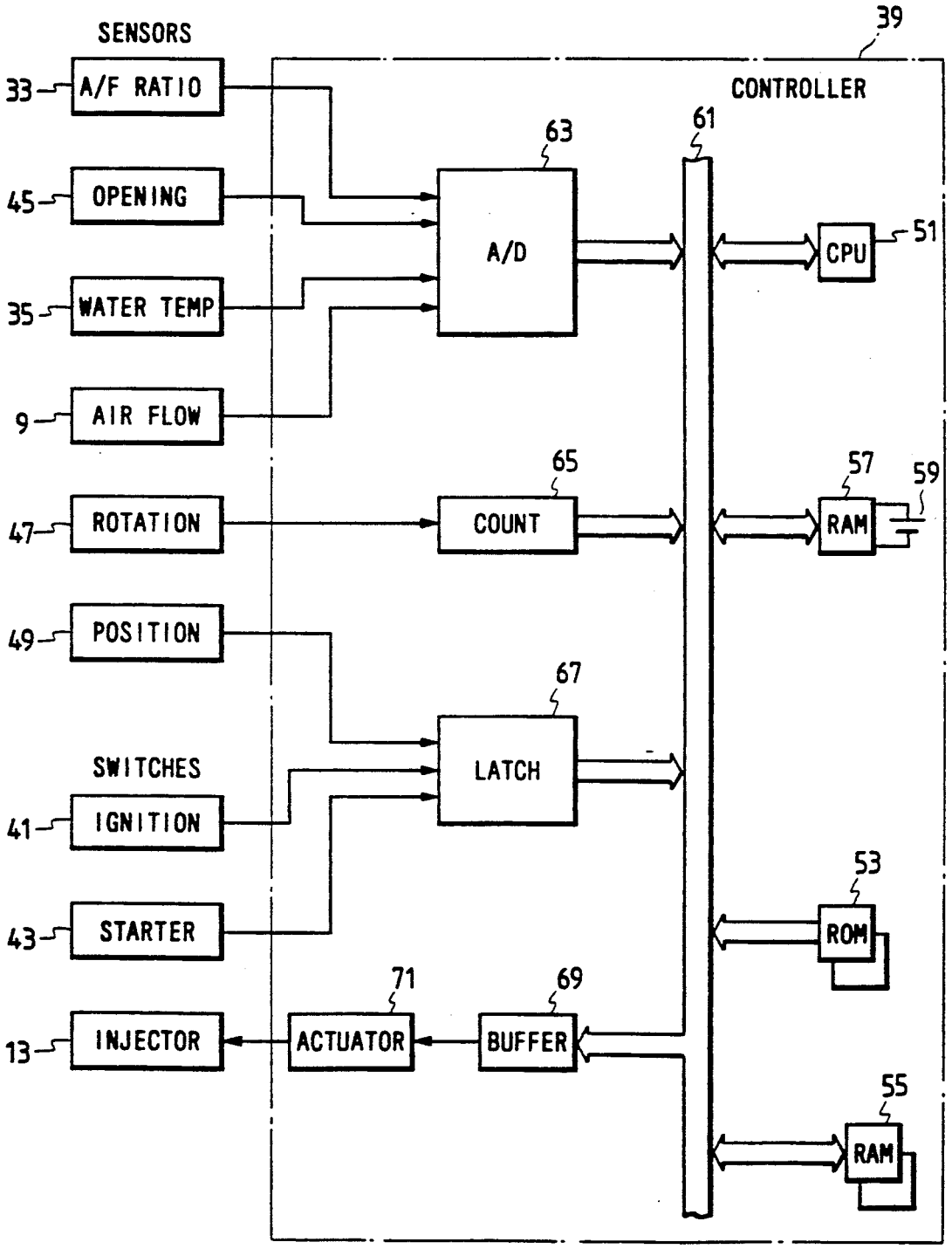
FIG. 2 schematically shows a construction of a controller used in the embodiment of FIG. 1.

Referring next to FIG. 2, the construction of the controller 39 will be described further in detail. In the figure, the same parts as in FIG. 1 are indicated by the same reference numerals. Further, as already described, valve opening sensor 45 is associated with the throttle valve 5, and rotation sensor 47 and position sensor 49 are provided in the distributor 25.

The controller 39 is composed of a microprocessor and appropriate peripheral equipment. The microprocessor, as usual, comprises central processing unit (CPU) 51 for executing various predetermined processing, read-only memory (ROM) 53 for storing programs for the predetermined processing and various variables necessary for executing the programs and random access memory (RAM) 55 for temporarily storing various data. The microprocessor has another random access memory 57 called a backup RAM, which is backed up by battery 59 and stores data which is to be maintained even after the operation of the engine 23 has stopped. These components of the microprocessor are coupled with each other through bus 61.

As the peripheral equipment, the microprocessor as mentioned above is provided with the following input/output equipment. First of all, there is an analog to digital converter (A/D) 63 coupled to the bus 61, which receives analog signals from the A/F ratio sensor 33, the valve opening sensor 45, the water temperature sensor 35 and the airflow sensor 9 and converts them into digital signals. The respective signals converted to digital form are taken into the microprocessor through the bus 61.

There is further provided a counter 65, which counts pulses supplied by the rotation sensor 47 for every predetermined period to produce a rotation signal proportional to the rotational speed of the engine 23. Also, the rotation signal is taken into the microprocessor through the bus 61. Furthermore, a latch 67 is coupled to the bus 61, in which signals from the position sensor 49, the ignition switch 41 and the starter switch 43 are temporarily kept, until they are taken into the microprocessor.

In addition to the input peripheral equipment as mentioned above, an output buffer register 69 is also coupled to the bus 61. The buffer 69 temporarily stores the result of the processing in the microprocessor and outputs it to actuator 71 at an appropriate timing. The output signal from the buffer 69 is converted in an analog form to be supplied to the actuator 71, whereby the injector 13 is driven in response to the processing result of the microprocessor.

Further, for the sake of brevity, the ignition unit 27 in FIG. 2 is omitted because the present invention is not concerned with the ignition control system.

Moreover, the operation of the input/output equipment as mentioned above is controlled by control signals, which are generated by the CPU 51 executing a predetermined processing and supplied to the respective equipment through various control lines. In the figure, however, such control lines are omitted, too.

In the following, a description will be given of the principle underlying an injection pulse generating method according to the present invention. In the following description, the amount of fuel to be injected by the injector 13 will be indicated in terms of time (fuel injection time) of a pulse width of an injection pulse signal applied to the injector 13.

The fuel injection time $T_i$ according to the present invention is determined in accordance with the following formula:

$$\begin{aligned} T_i &= k_1 \times (Q_a/N) \times (1 - k_2) \\ &= T_i' \times (1 - k_2) \end{aligned} \quad (1)$$

wherein $Q_a$: the quantity of the sucked air;

N: the rotational speed of the engine (rpm); and $k_1$, $k_2$: constants.

As is well known, a basic fuel injection time $T_i'$ is determined in proportion to the ratio $Q_a/N$ of the suction air quantity $Q_a$ to the rotational speed N. The constant $k_1$ is a proportional constant therefor. Usually, the thus obtained basic fuel injection time $T_i'$ is corrected in response to an A/F ratio detected, for example. Although the formula (1) above does not include a factor for such correction in order to simplify the description, it will be easily understood that such factor can be incorporated in the formula (1).

Further, as is already known, the basic fuel injection time $T_i'$ as mentioned above can be determined by using other fundamental parameters indicative of the operational condition of the engine 23, such as the opening of the throttle valve 5, the negative pressure within the suction pipe 3 etc. as well as the rotational speed N of the engine 23. It is to be noted that the present invention is not subject to any limitation by way of determining the basic fuel injection time $T_i'$.

The constant $k_2$ is a coefficient, which is provided in accordance with the present invention, for the purpose of correcting the basic fuel injection time $T_i'$ as obtained above. The correction coefficient $k_2$ is zero during the normal operating condition and assumes appropriate values determined by the present invention when acceleration or deceleration of the engine 23 is required.

Usually, the engine 23 is supplied with an amount of fuel determined according to the formula (1) twice for every one rotation thereof at a predetermined timing. If, however, especially rapid acceleration is required, the engine 23 can be supplied with extra fuel by interruption injection which is not synchronized with the predetermined timing, similarly to the conventional fuel injection control.

The determination of the correction coefficient $k_2$ is performed by using fuzzy reasoning. To this end, the following linguistic control rules are provided;

(1) If the acceleration required is small, then $k_2$ is increased to a small extent;

(2) If the acceleration required is large, then $k_2$ is increased to a large extent;

(3) If the deceleration required is small, then $k_2$ is decreased to a small extent; and (4) If the deceleration required is large, then $k_2$ is decreased to a large extent.

Figure 3A:
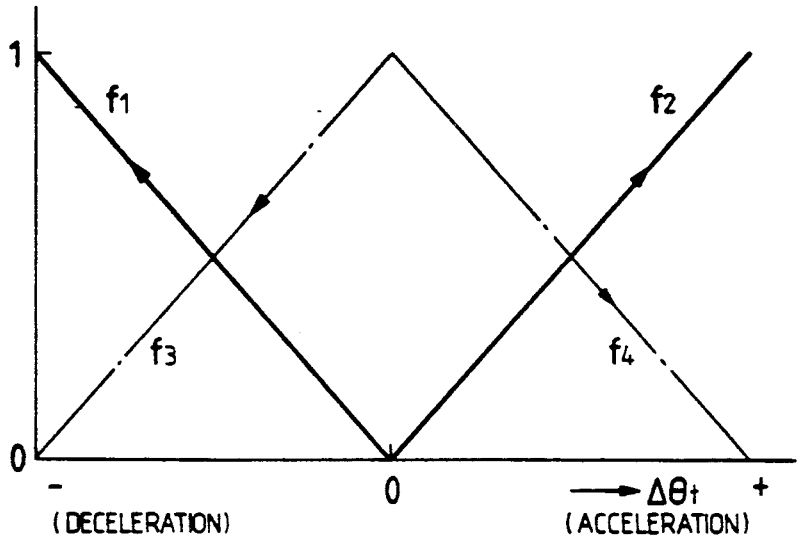
FIGS. 3*a* and 3*b* are drawings for illustrating examples of membership functions used in the control apparatus according to the embodiment of FIG. 1.
Figure 3B:
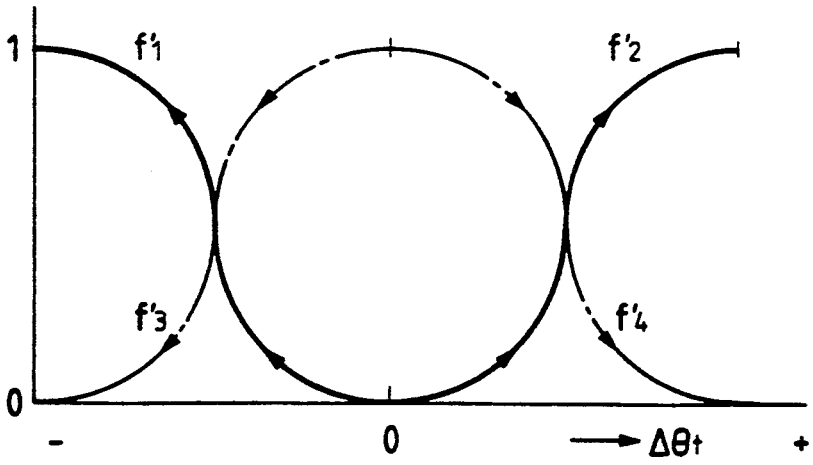

Indexes including the fuzziness, such as "small" or "large" in the "if" clauses of the linguistic control rules above, are defined by membership functions in the fuzzy technique. FIGS. 3*a* and 3*b* show examples of such membership functions.

In both figures, an abscissa indicates the degree of acceleration or deceleration required in terms of $\Delta\theta_t$, which is the changing rate per unit time of the opening degree $\theta_t$ of the throttle valve 5. The center of the abscissa represents a point $\Delta\theta_t=0$. Since $\Delta\theta_t$ is in proportion to the acceleration or deceleration, the right-hand side of the abscissa with respect to 0, i.e., the positive side thereof, represents the acceleration region, and on the contrary, the left-hand side of the abscissa with respect to 0, i.e., the negative side thereof, represents the deceleration region. The ordinate in the figures is a non-dimensional axis.

Further, although the abscissa in FIGS. 3*a* and 3*b* is indicated in terms of the changing rate $\Delta\theta_t$ of the opening of the throttle valve, it should be understood that other operational parameters indicating an acceleration or deceleration can be used.

In the examples of FIGS. 3*a* and 3*b*, there are provided four membership functions $f_1$, $f_2$, $f_3$, $f_4$ and $f_1'$, $f_2'$, $f_3'$, $f_4'$, respectively. As shown in the figures, every membership function changes between 0 and 1 with respect to $\Delta\theta_t$. The membership functions $f_1$, $f_2$, $f_3$, $f_4$ of FIG. 3*a* are all linear and therefore suited for universal use. The membership functions $f_1'$, $f_2'$, $f_3'$, $f_4'$ of FIG. 3*b* are composed of two continuing arcs of a quarter of a circle, respectively. As a result, there exists a non-sensitive zone in the region of very small values of $\Delta\theta_t$ and in the region where the absolute value of $\Delta\theta_t$ is large.

Although the kind of membership function can be selected in accordance with the necessity of control, the determination of the coefficient $k_2$ will be explained here, using the membership functions as shown in FIG. 3*a*.

Figure 4A:
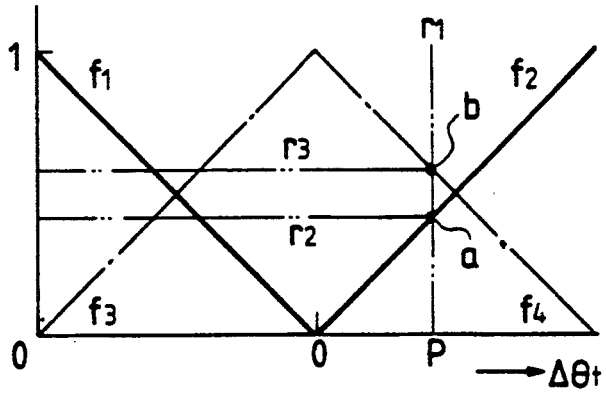
FIGS. 4*a* to 4*d* and FIGS. 5*a* and 5*b* are drawings for explaining the principle of determining a correction coefficient for a supply amount of fuel, using the membership functions, in the case where acceleration is required.

Let us assume that, as shown in FIG. 4*a*, the acceleration corresponding to point P is required and that this is detected from the changing rate $\Delta\theta_t$ of the opening of the throttle valve 5. At first, there are obtained cross points a and b, at which line $r_1$ of $\Delta\theta_t=P$ intersects the membership functions $f_2$ and $f_4$, respectively. Then, two lines $r_2$ and $r_3$ are drawn, which are parallel to the abscissa and pass through the points a and b, respectively.

Figure 4B:
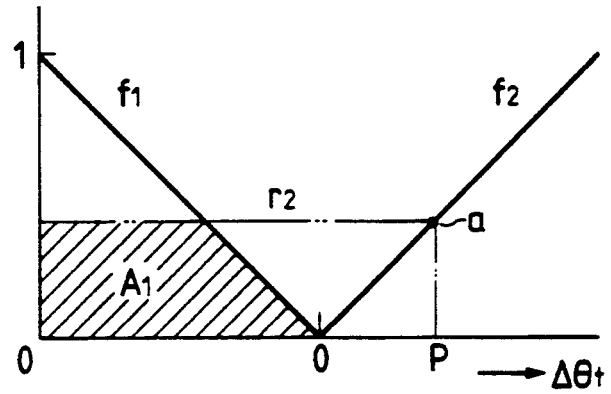
Figure 4C:
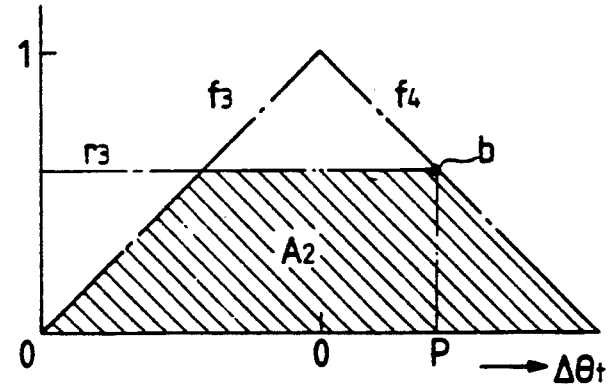

As a result, a first figure as indicated by a hatched portion in FIG. 4*b* is formed by the membership function $f_1$ and the line $r_2$, and then an area $A_1$ thereof is obtained by the calculation. Further, a second figure as indicated by a hatched portion in FIG. 4*c* is formed by the membership functions $f_3$ and $f_4$ and the line $r_3$, and an area $A_2$ thereof is calculated.

Figure 4D:
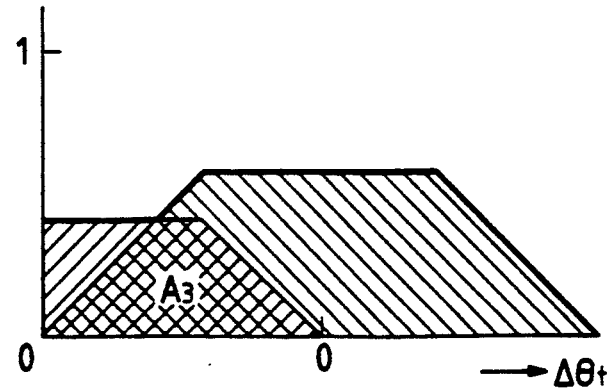

If the two figures thus obtained are overlapped, a third figure as surrounded by a thick line and the coordinate axes in FIG. 4*d* can be formed. Further, if the areas $A_1$ and $A_2$ are added to each other and an area $A_3$ of an overlapped portion in the third figure is subtracted from the summation of $A_1+A_2$, an area A of the third figure can be obtained.

Figure 5A:
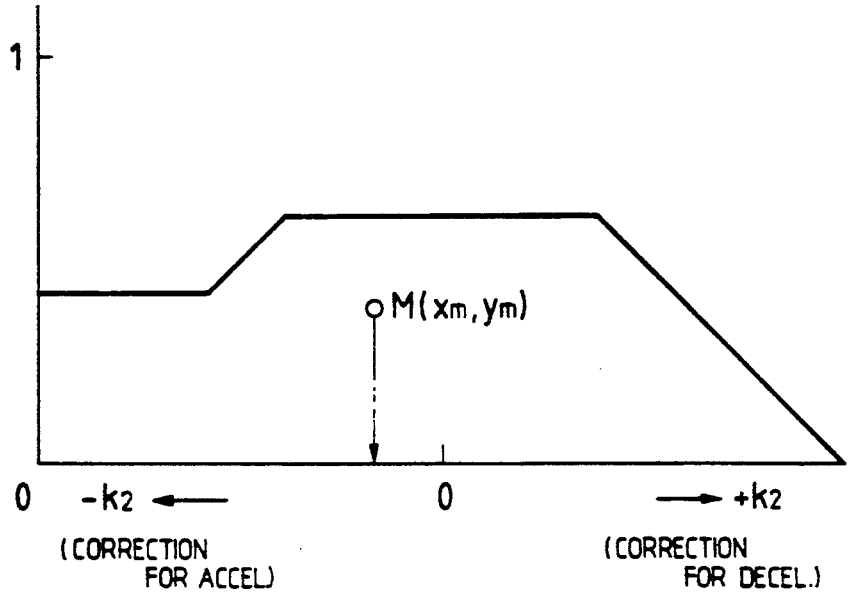
Figure 5B:
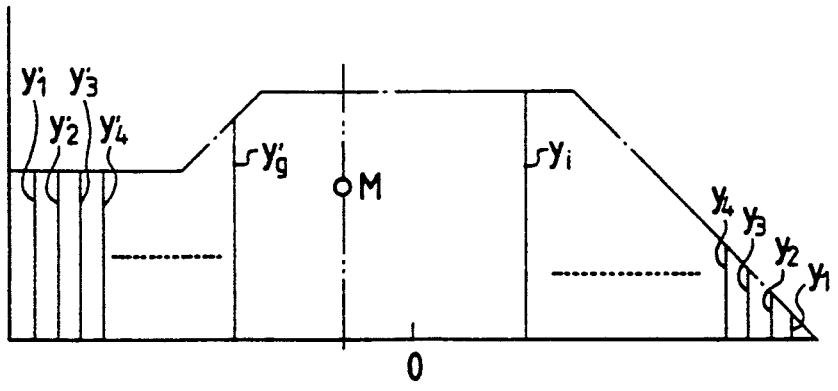

Next, the correction coefficient $k_2$ is determined on the basis of the thus obtained third figure. Referring to FIGS. 5*a* and 5*b*, the way of determining it will be explained below. It is to be noted that the abscissa in FIG. 5*a* is represented as the correction coefficient $k_2$, which is converted from the changing rate $\Delta\theta_t$ of the opening of the throttle valve 5 simply in a proportional relationship.

At first, a centroid M of the third figure is obtained as shown in FIG. 5. If coordinates of the obtained centroid M are expressed by $(x_m, y_m)$, $x_m$ on the abscissa affords the correction coefficient $k_2$. In the case as shown in FIG. 5*a*, a negative value is obtained as the correction coefficient $k_2$. If this value is applied to the formula (1), the basic fuel injection time $T_i'$ is corrected so as to increase accordingly.

The aforesaid $x_m$ of the centroid M is obtained as follows. As shown in FIG. 5*b*, the base (abscissa) of the third figure is divided into plural segments at equal intervals. Values $y_1, y_2, y_3, y_4, \ldots, y_i$ of the ordinate for every segment are added one after another from the right end of the figure. If the intervals of the segments are selected to be sufficiently small, the summation of this addition becomes substantially equal to an area $S_{Ri}$ of a portion of the figure, which is on the right-hand side with respect to $y_i$.

Similarly, values $y_1'$, $y_2'$, $y_3'$, $y_4'$, . . . , $y_j'$ of the ordinate for every segment are added, whereby an area $S_{Lj}$ of a portion of the figure, which is on the left-hand side with respect to $y_j'$, can be obtained. These additions of $y_1$, $y_2$, $y_3$, $y_4$, . . . , $y_i$ and $y_1'$, $y_2'$, $y_3'$, $y_4'$, . . . , $y_j'$ are performed, while always comparing the respective summations with each other, whereby a segment, at which both areas $S_{Ri}$ and $S_{Lj}$ become equal to each other, is found. A value of the abscissa of the thus obtained segment becomes the value $x_m$ of the abscissa of the centroid M, which affords the correction coefficient $k_2$.

The foregoing description has been concerned with the case where it was detected that acceleration is required. The correction coefficient $k_2$ when it is detected that deceleration is required can be determined in an analogous manner. This will be explained briefly, referring to FIGS. 6a to 6d.

Figure 6A:
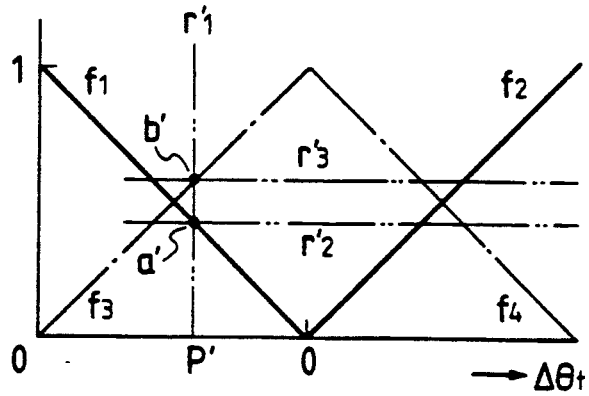
FIGS. 6*a* to 6*d*, similarly to FIGS. 4*a* to 4*d*, are drawings for explaining the principle of determining a correction coefficient for a supply amount of fuel, when deceleration is required.

Assuming that, as shown in FIG. 6a, it is detected from the changing rate $\Delta\theta_t$ that deceleration corresponding to point P' is required, there are at first obtained cross points a' and b', at which line $r_1'$ of $\Delta\theta_t$=P' intersects the membership functions $f_1$ and $f_3$, respectively. Then, two lines $r_2'$ and $r_3'$ are drawn, which are parallel to the abscissa and pass through the points a' and b', respectively.

Figure 6B:
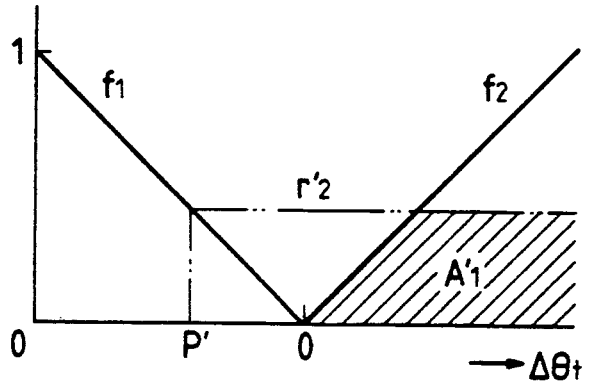
Figure 6C:
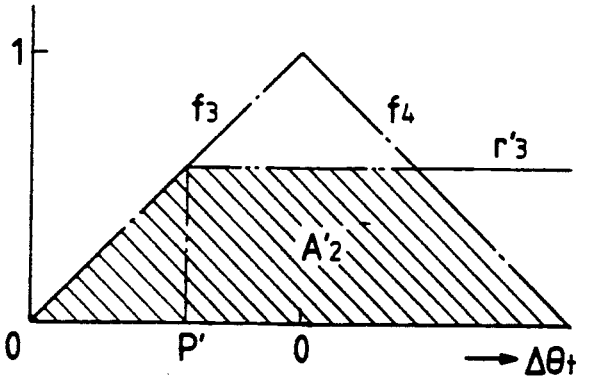

Then, there is calculated an area $A_1'$ of a first figure, which, as shown in FIG. 6b, is formed by the membership function $f_2$ and the line $r_2'$. There is further calculated an area $A_2'$ of a second figure, which, as shown in FIG. 6c, is formed by the membership functions $f_3$, $f_4$ and the line $r_3'$.

Figure 6D:
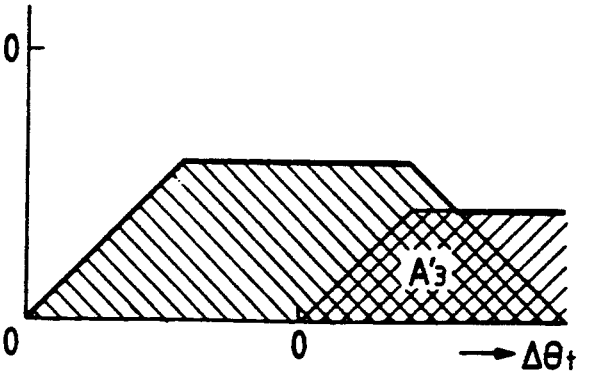

By overlapping the two figures thus obtained as shown in FIG. 6d, a third figure as surrounded by a thick line and the coordinate axes in the figure is formed. After that, in the same manner as the foregoing case, the centroid M of the thus obtained third figure is obtained and the correction coefficient $k_2$ can be determined on the basis of a value of the abscissa of the centroid M.

Figure 7A:
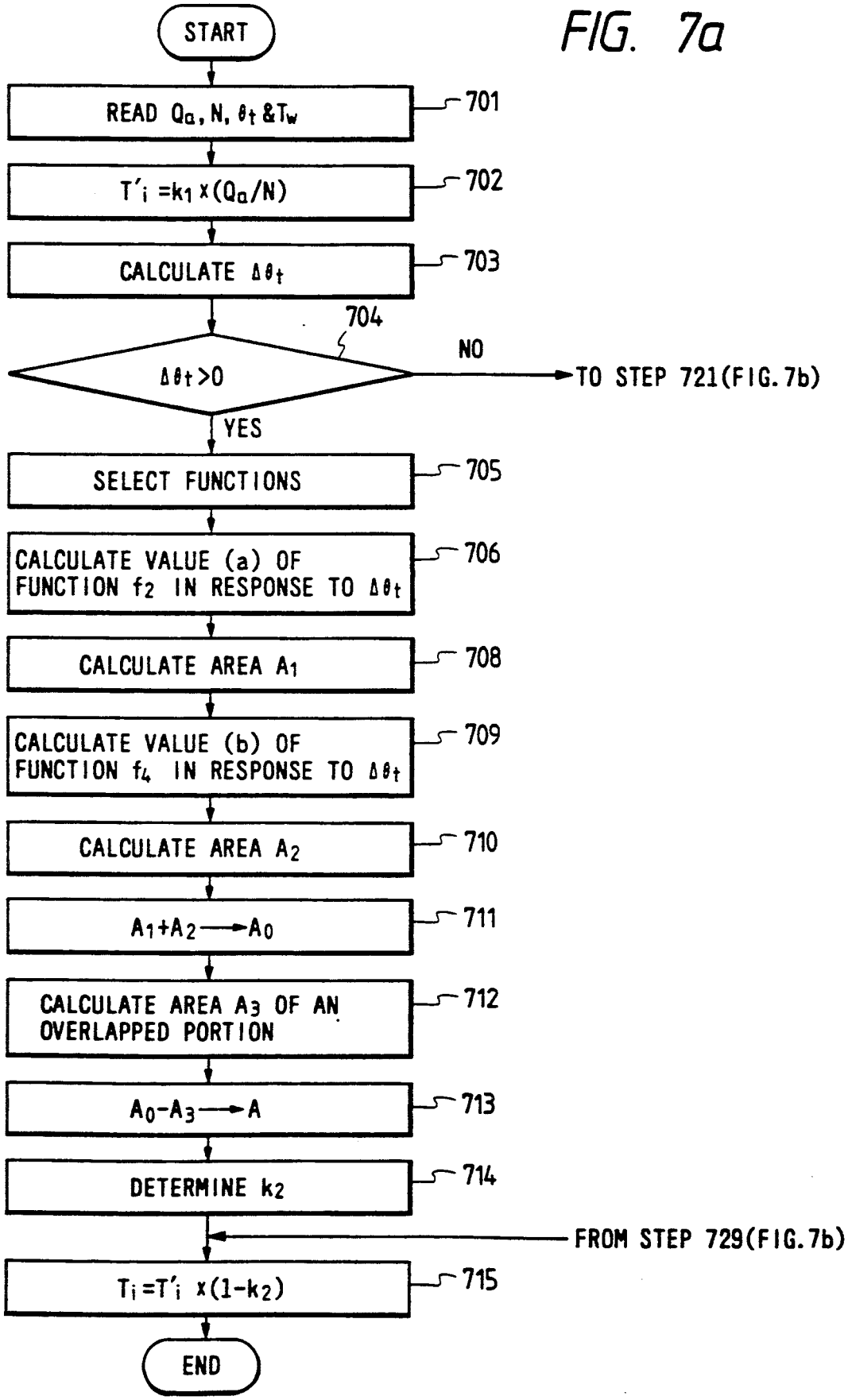
FIGS. 7*a* and 7*b* are flow charts for explaining the processing operation executed in the controller of FIG. 2.
Figure 7B:
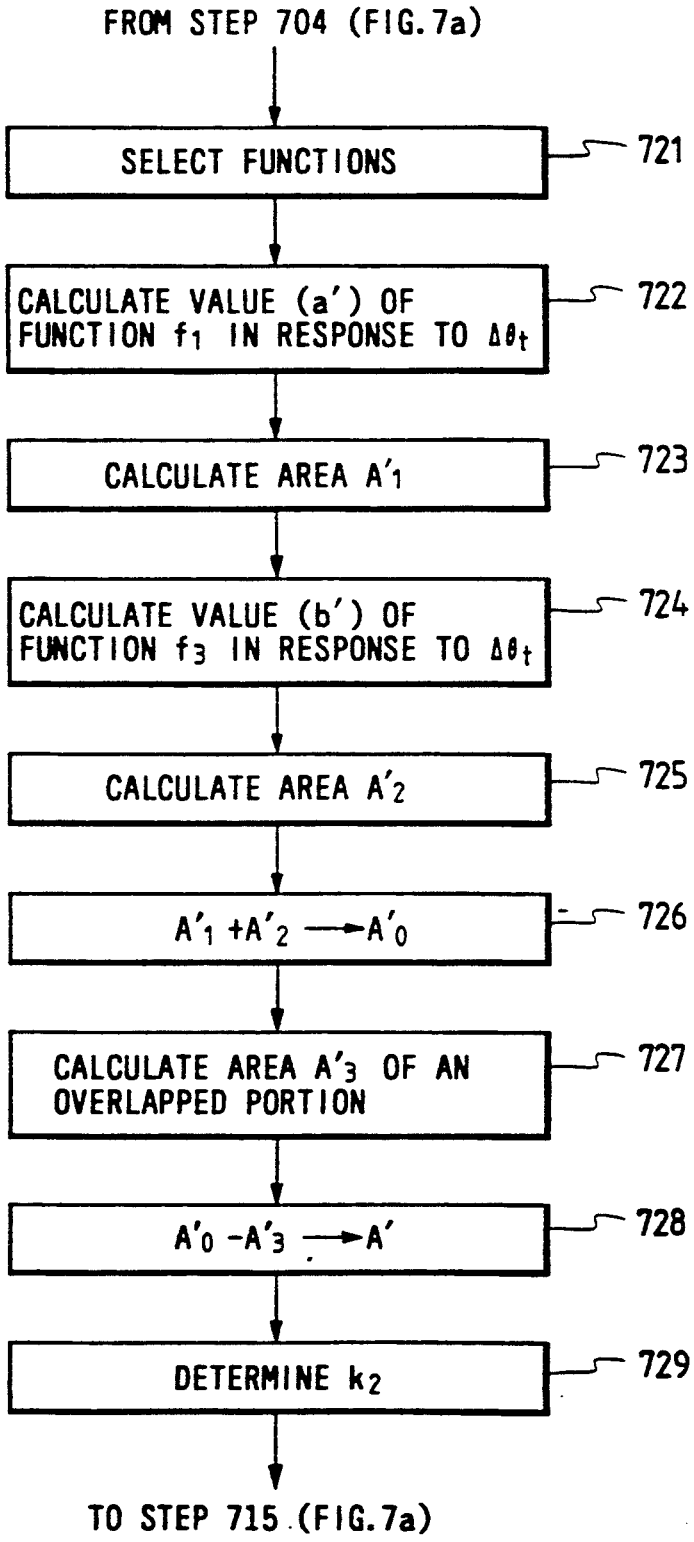

Referring next to the flow charts of FIGS 7a and 7b, the processing operation of the microprocessor of the controller 39 will be explained below.

In the same manner as a conventional fuel injection control, this processing operation is executed every 2 to 10 msec. Thereafter, at first, values of the suction air quantity $Q_a$, the rotational speed N, the valve opening angle $\theta_t$ and the water temperature $T_W$ are taken into the microprocessor from the respective sensors at step 701, and they are temporarily stored in appropriate areas of the RAM 55.

At step 702, the basic fuel injection time $T_i'$ is calculated on the basis of the suction air quantity $Q_a$ and the rotational speed N. As already described, the consideration of the correction based on the A/F ratio is omitted here. Then, at step 703, the changing rate $\Delta\theta_t$ of the valve opening $\theta_t$ is calculated. This is obtained on the basis of the difference between the value of $\theta_t$ stored in the execution cycle the last time and that read this time.

Then, it is judged at step 704 whether or not $\Delta\theta_t$ is positive. If $\Delta\theta_t$ is discriminated to be positive, this means that acceleration is required. This is the case that has been explained with reference to FIGS. 4a to 4d. In this case, the processing operation goes to step 705. When $\Delta\theta_t$ is discriminated to be not positive, the processing operation goes to step 721 of FIG. 7b, since deceleration is required. The processing operation of step 721 and the following will be described later.

At step 705, a set of membership functions is selected in accordance with the water temperature $T_W$ from among various membership functions prepared in advance. In the following explanation, it is assumed that the membership functions $f_1$ to $f_4$ as shown in FIG. 3a are selected.

At step 706, a value of the function $f_2$ in response to $\Delta\theta_t$ obtained at step 703 is calculated. This value corresponds to a value of the ordinate of the cross point a as shown in FIG. 4a. Next, the area $A_1$ of the first figure as shown in FIG. 4b is calculated at step 708. At step 709, a value of the function $f_4$ in response to $\Delta\theta_t$ obtained at step 703 is calculated. This value corresponds to a value of the cross point b as shown in FIG. 4a. Then, the area $A_2$ of the second figure as shown in FIG. 4c is calculated at step 710.

After that, the area $A_1$ is added to the area $A_2$ to obtain the summation $A_0$ at step 711. At step 712, the area $A_3$ of the overlapped portion of the third figure as shown in FIG. 4d is calculated. Then, at step 713, the area $A_3$ of the overlapped portion is subtracted from the summation $A_0$ to thereby obtain the area A of the third figure.

At step 714, the centroid of the third figure is obtained, and the correction coefficient $k_2$ is determined on the basis of the centroid obtained. Finally, the basic fuel injection time $T_i'$ obtained at step 702 is corrected by using the correction coefficient $k_2$ as determined above, and the processing operation ends.

Next, description will be made of the case where it is discriminated at step 704 that $\Delta\theta_t$ is not positive, referring to FIG. 7b. This is the case that has been explained with reference to FIGS. 6a to 6d. In this case, the processing operation branches to step 721 of FIG. 7b from step 704 of FIG. 7a.

At first, at step 721, a set of membership functions is selected in accordance with the water temperature $T_W$. Then, at step 706, a value of the function $f_1$ in response to $\Delta\theta_t$ obtained at step 703 is calculated. This value corresponds to a value of the ordinate of the cross point a' as shown in FIG. 6a. Then, the area $A_1'$ of the first figure as shown in FIG. 6b is calculated at step 723.

At step 724, a value of the function $f_3$ in response to $\Delta\theta_t$ obtained at step 703 is calculated. This value corresponds to a value of the ordinate of the cross point b' as shown in FIG. 6a. Then, the area $A_2'$ of the second figure as shown in FIG. 6c is calculated at step 725.

After that, the area $A_1'$ is added to the area $A_2'$ to obtain the summation $A_0'$ at step 726. At step 727, the area $A_3'$ of the overlapped portion of the third figure is calculated. Then, at step 728, the area $A_3'$ of the overlapped portion is subtracted from the summation $A_0'$ to thereby obtain the area A' of the third figure.

At step 729, the centroid of the third figure is obtained, and the correction coefficient $k_2$ is determined on the basis of the centroid obtained. Thereafter, the processing operation goes to step 715 of FIG. 7a, at which the basic fuel injection time $T_i'$ obtained at step 702 is corrected by using the correction coefficient $k_2$ as determined above, and the processing operation ends.

We claim:

1. A control apparatus for an internal combustion engine, comprising:

a control device for controlling a control operation of the internal combustion engine in response to a control signal applied thereto;

sensing means for detecting operational conditions relating to at least one fundamental parameter of internal combustion engine operation controlled by said control operation in response to a command from an operator and for producing sensor signals indicative of detected operational conditions; and a controller for executing a predetermined processing using said sensor signals to produce said control signal for control of said control device, including a microprocessor producing a basic signal to control said control operation and correcting said basic signal using a correction coefficient in accordance with the degree of control of said fundamental parameter commanded by the operator to produce said control signal supplied to said control device, said microprocessor being provided with membership functions varying linearly with respect to said fundamental parameter, which membership functions are used by said microprocessor only to determine said correction coefficient for correcting said basic signal on the basis of the degree of control of said fundamental parameter commanded by the operator in accordance with fuzzy reasoning.

2. A control apparatus for an internal combustion engine, comprising:

a control device for controlling a control operation of the internal combustion engine in response to a control signal applied thereto;

sensing means for detecting operational conditions relating to at least one fundamental parameter of internal combustion engine operation controlled by said control operation in response to a command from an operator and for producing sensor signals indicative of detected operational conditions; and a controller for executing a predetermined processing using said sensor signals to produce said control signal for control of said control device, including a microprocessor producing a basic signal to control said control operation and correcting said basic signal using a correction coefficient in accordance with the degree of control of said fundamental parameter commanded by the operator to produce said control signal supplied to said control device, said microprocessor being provided with membership functions varying with respect to said fundamental parameter, which membership functions determine said correction coefficient for correcting said basic signal on the basis of the degree of control of said fundamental parameter commanded by the operator in accordance with fuzzy reasoning, wherein said control operation is fuel injection and said fundamental parameter relates to acceleration and deceleration.

3. A control apparatus according to claim 2, wherein the membership functions have a non-sensitive zone at least in the region where acceleration or deceleration is small.

4. A control apparatus for an internal combustion engine, comprising:

a control device for controlling a control operation of the internal combustion engine in response to a control signal applied thereto;

sensing means for detecting operational conditions relating to at least on fundamental parameter of internal combustion engine operation controlled by said control operation in response to a command from an operator and for producing sensor signals indicative of detected operational conditions; and a controller for executing a predetermined processing using said sensor signals to produce said control signal for control of said control device, including a microprocessor producing a basic signal to control said control operation and correcting said basic signal using a correction coefficient in accordance with the degree of control of said fundamental parameter commanded by the operator to produce said control signal supplied to said control device, said microprocessor being provided with membership functions varying with respect to said fundamental parameter, which membership functions determine said correction coefficient for correcting said basic signal on the basis of the degree of control of said fundamental parameter commanded by the operator in accordance with fuzzy reasoning, wherein said microprocessor is provided with various kinds of membership functions and a set of membership functions is selected in accordance with engine temperature.

5. A control apparatus for an internal combustion engine, comprising:

a control device for controlling a control operation of the internal combustion engine in response to a control signal applied thereto;

sensing means for detecting operational conditions relating to at least one fundamental parameter of internal combustion engine operation controlled by said control operation in response to a command from an operator and for producing sensor signals indicative of detected operational conditions; and a controller for executing a predetermined processing using said sensor signals to produce said control signal for control of said control device, including a microprocessor producing a basic signal to control said control operation and correcting said basic signal using a correction coefficient in accordance with the degree of control of said fundamental parameter commanded by the operator to produce said control signal supplied to said control device, said microprocessor being provided with membership functions varying with respect to said fundamental parameter, which membership functions determine said correction coefficient for correcting said basic signal on the basis of the degree of control of said fundamental parameter commanded by the operator in accordance with fuzzy reasoning, wherein said fundamental parameter is acceleration or deceleration, and said sensor means detects the degree of acceleration or deceleration commanded by the operator by detecting a changing rate of opening of a throttle valve of the internal combustion engine.

6. A control apparatus according to claim 5, wherein said correction coefficient is zero during steady speed running of the engine.

7. A control apparatus for an internal combustion engine, comprising:

a control device for controlling a control operation of the internal combustion engine in response to a control signal applied thereto;

sensing means for detecting operational conditions relating to at least one fundamental parameter of internal combustion engine operation controlled by said control operation in response to a command from an operator and for producing sensor signals indicative of detected operational conditions; and a controller for executing a predetermined processing using said sensor signals to produce said control signal for control of said control device, including a microprocessor producing a basic signal to control said control operation and correcting said basic signal using a correction coefficient in accordance with the degree of control of said fundamental parameter commanded by the operator to produce said control signal supplied to said control device, said microprocessor being provided with membership functions varying with respect to said fundamental parameter, which membership functions determine said correction coefficient for correcting said basic signal on the basis of the degree of control of said fundamental parameter commanded by the operator in accordance with fuzzy reasoning, wherein the microprocessor executes the following steps:

obtaining functional values of the membership functions in response to the degree of control of said fundamental parameter commanded by the operator;

calculating an area of a figure which is formed on the basis of said functional values obtained in the previous step;

obtaining a centroid of the figure; and determining said correction coefficient on the basis of the thus obtained centroid of the figure.

* * * * *